US006778149B2

(12) United States Patent
Fukae et al.

(10) Patent No.: US 6,778,149 B2
(45) Date of Patent: Aug. 17, 2004

(54) COMPOSITE ANTENNA APPARATUS

(75) Inventors: Isao Fukae, Chofu (JP); Masaaki Miyata, Machida (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/323,443

(22) Filed: Dec. 19, 2002

(65) Prior Publication Data

US 2003/0117339 A1 Jun. 26, 2003

(30) Foreign Application Priority Data

Dec. 20, 2001 (JP) ..... 2001-387060

(51) Int. Cl.[7] ..... H01Q 1/36

(52) U.S. Cl. ..... 343/895; 343/900; 343/725; 343/728

(58) Field of Search ..... 343/895, 900, 343/903, 725, 728, 741, 745, 748, 751, 893, 866, 749

(56) References Cited

U.S. PATENT DOCUMENTS 6,160,512 A * 12/2000 Desclos et al. ..... 343/700 MS
6,373,448 B1 * 4/2002 Chun ..... 343/895
6,538,611 B2 * 3/2003 Noro ..... 343/725
2002/0030629 A1 * 3/2002 Nybeck et al. ..... 343/702

* cited by examiner

*Primary Examiner*—Tuyet T Vo
(74) *Attorney, Agent, or Firm*—Frishauf, Holtz, Goodman & Chick, P.C.

(57) ABSTRACT

A composite antenna apparatus includes a cylindrical member 4 formed by a flexible insulating film rolled into a cylindrical shape, a plurality of antenna patterns 3 formed in a helix pattern on a peripheral surface of the cylindrical member 4, a circuit board 2 fixed to one axial end of the cylindrical member 4 and having a circuit pattern 10 connected to the antenna patterns 3 by soldering, and a monopole antenna 1 disposed inside the cylindrical member 4 and standing up on one surface of the circuit board 2. The circuit board 2 is provided with a first metallic pattern 8 having a predetermined area and formed on the one surface of the circuit board 2 at a position inside the cylindrical member 4.

1 Claim, 3 Drawing Sheets

COMPOSITE ANTENNA APPARATUS

This application claims priority to prior application JP 2001-387060, the disclosure of which is incorporated herein by reference.

BACKGROUND OF THE INVENTION

This invention relates to a digital radio receiver for receiving a radio wave from an artificial satellite (which may be called a "satellite wave" hereinafter) or a radio wave from a ground station (which may be called a "ground wave" hereinafter) to listen to digital radio broadcasting and, in particular, to a composite antenna apparatus for use in the digital radio receiver.

In recent years, a digital radio receiver for receiving a radio wave from an artificial satellite (satellite wave) or a ground wave to listen to digital radio broadcasting has been developed and is about to be put into practical use in United States of America. The digital radio receiver is mounted on a mobile station, such as a vehicle, and is adapted to receive a radio wave having a frequency of about 2.3 GHz to listen to the digital radio broadcasting. In other words, the digital radio receiver is a radio receiver capable of listening to mobile broadcasting. It is noted here that the ground wave is a radio wave obtained by slightly shifting the frequency of the satellite wave after it is received by the ground station.

In order to receive the radio wave having the frequency of about 2.3 GHz, it is necessary to mount an antenna at a position outside a vehicle. Such antenna may have various structures but generally has a stick-type structure rather than a planar-type (or a flat-type) structure.

As well known, an electromagnetic wave emitted into a free space is a transversal wave having an electric field and a magnetic field vibrating or oscillating in a plane perpendicular to a propagating direction of the wave. In some circumstances, the oscillation of the electric field and the magnetic field is restricted to a specific direction. Such nature is referred to as polarization and such wave is called a polarized wave. The satellite wave uses a circular polarized wave exhibiting circular polarization while the ground wave uses a linear polarized wave exhibiting linear polarization.

Hereinafter, description will mainly be made about an antenna for receiving the satellite wave. As one of stick-type antennas, a helical antenna is known. The helical antenna comprises a hollow or solid cylindrical member and at least one conductor wire wound around the cylindrical member in a helix pattern (or a spiral pattern). The helical antenna can efficiently receive the above-mentioned circular polarized wave. Therefore, the helical antenna is frequently used to receive the satellite wave. The cylindrical member is made of an insulating material such as plastic. The number of conductor wires is equal to, for example, four. Practically, it is very difficult to wind at least one conductor wire around the cylindrical member in a helix pattern. Instead, proposal is made of a structure in which an insulating film with at least one conductor pattern printed thereon is wound around the cylindrical member.

Referring to FIGS. 1 and 2, an existing composite antenna apparatus comprises a monopole antenna 11 having a finite ground plane and disposed on a circuit board 12, and a cylindrical member 14 with a plurality of conductor patterns 13 formed on its peripheral surface and extending in a helix pattern. A combination of the cylindrical member 14 and the conductor patterns 13 forms a helical antenna. The cylindrical member 14 is formed by an insulating film rolled into a cylindrical shape and fixed to keep the cylindrical shape. In the composite antenna apparatus, the finite ground plane has a radius equal to ¼ wavelength and the monopole antenna 11 has a length equal to ¼ wavelength. With the above-mentioned structure, the capacitance is large under the influence of the helical antenna around the monopole antenna 11 so that impedance matching is difficult. Therefore, in the existing composite antenna apparatus having the above-mentioned structure, it is necessary to provide a matching circuit 15 connected through a lead wire 16 to the circuit board 12, as shown in FIG. 3. The matching circuit 15 is disposed outside the composite antenna apparatus comprising the monopole antenna 11, the circuit board 12, and the cylindrical member 14. Therefore, the presence of the matching circuit is a bottleneck against miniaturization of the composite antenna apparatus.

SUMMARY OF THE INVENTION

It is an object of this invention to provide an antenna apparatus which itself has a function of a matching circuit so that the antenna apparatus is reduced in size.

According to this invention, there is provided a composite antenna apparatus comprising a cylindrical member formed by a flexible insulating member rolled into a cylindrical shape, a circuit board fixed to one axial end of the cylindrical member and provided with a first metallic pattern, and a monopole antenna disposed inside the cylindrical member and standing up on one surface of the circuit board, wherein the circuit board has a second metallic pattern formed on the other surface thereof, the monopole antenna having a coil portion wound in a spiral fashion.

In the above-mentioned composite antenna apparatus, the coil portion serves as an inductor. The monopole antenna serves as a resistor by its length. The first and the second metallic patterns serve as a capacitor. A combination of the coil portion, the monopole antenna, and the first and the second metallic patterns forms an RLC circuit which serves as a matching circuit.

DESCRIPTION OF THE PREFERRED EMBODIMENTS

Figure 1:
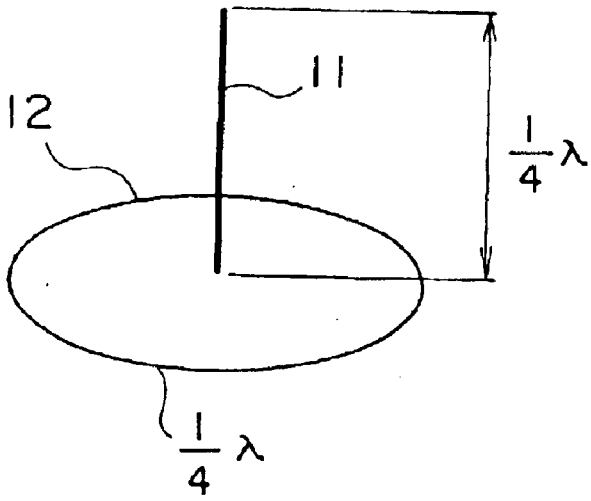
FIG. 1 is a view for describing the principle of a monopole antenna.
Figure 2:
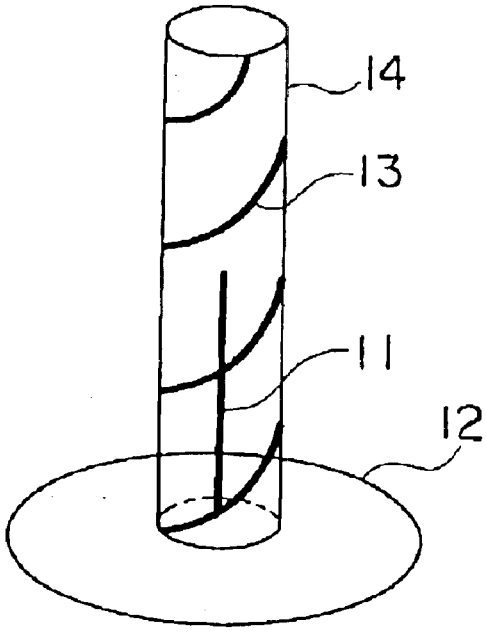
FIG. 2 RELATED ART
FIG. 2 is a perspective view of an existing composite antenna apparatus.
Figure 3:
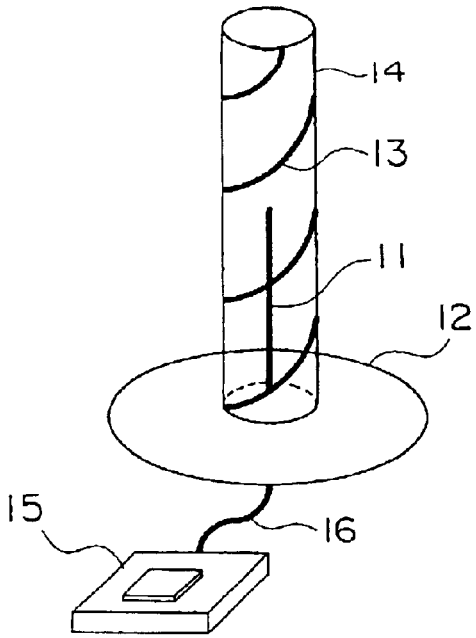
FIG. 3 RELATED ART
FIG. 3 is a perspective view of the existing composite antenna apparatus in FIG. 2 with a matching circuit connected thereto.

Now, description will be made of this invention with reference to the drawing.

Figure 4:
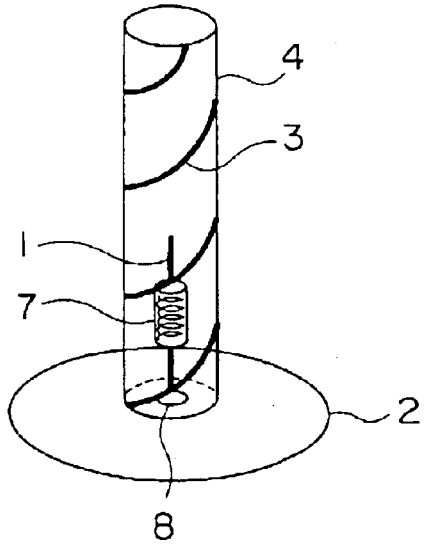
FIG. 4 is a perspective view of a composite antenna apparatus according to an embodiment of this invention.
Figure 5A:
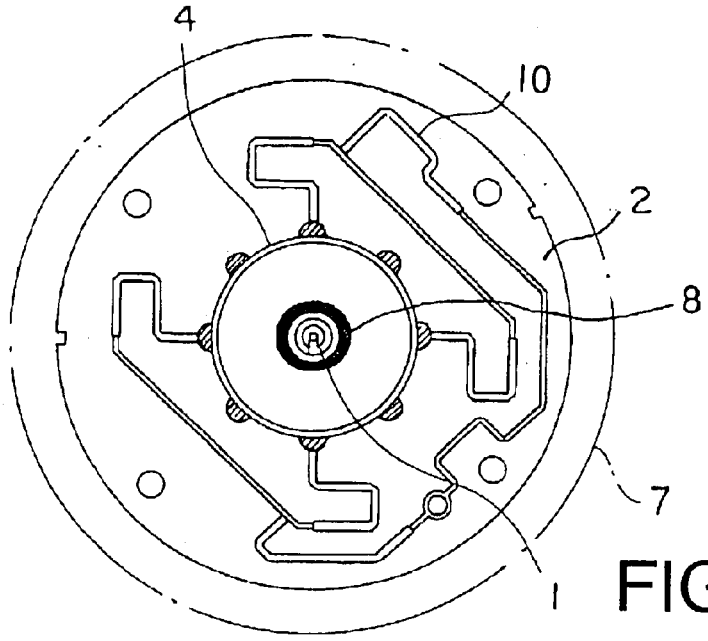
FIGS. 5A and 5B are a plan view and a front view of the composite antenna apparatus in FIG. 4, respectively, with an outer case depicted by imaginary lines.
Figure 5B:
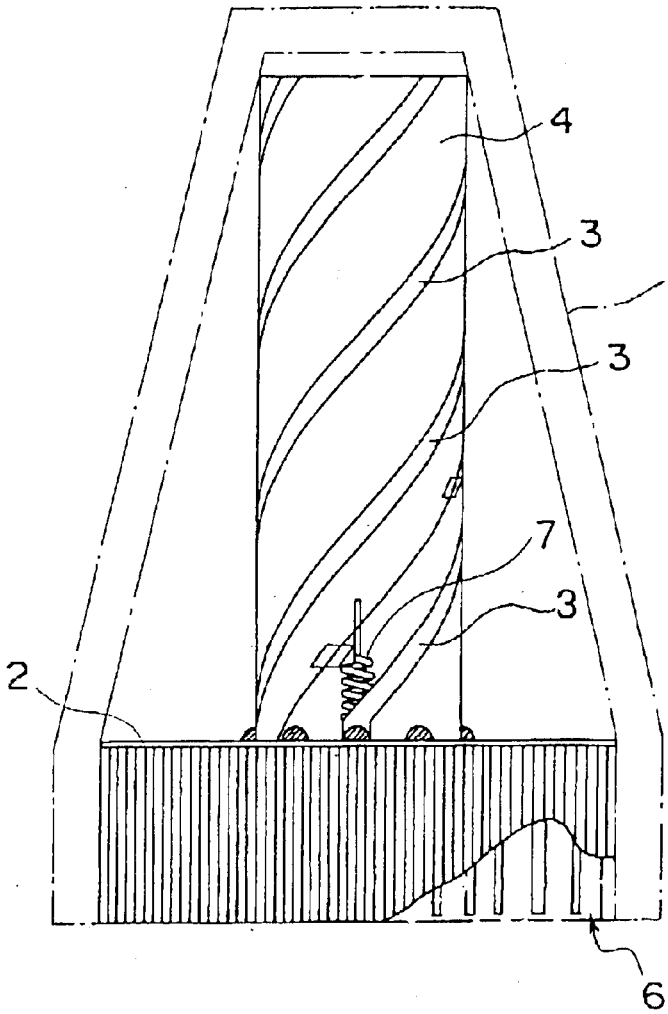

Referring to FIGS. 4, 5A, and 5B, a composite antenna apparatus according to an embodiment of this invention comprises a helical antenna and a monopole antenna. The composite antenna apparatus includes a cylindrical member 4 formed by a flexible insulating film rolled into a cylindrical shape, a plurality of antenna patterns 3, four in number, each of which comprises a conductor and which extend in a helix pattern along a peripheral surface of the cylindrical member 4, a circuit board 2 fixed to one axial end of the cylindrical member 4 and having a circuit pattern 10, such as a phase shift circuit, connected to the antenna patterns 3 by soldering, and a monopole antenna 1 disposed inside the cylindrical member 4 and standing up on one surface of the circuit board 2. A combination of the cylindrical member 4 and the antenna patterns 3 serves as a helical antenna. The circuit board 2 is provided with a first metallic pattern 8 having a predetermined area and formed on the one surface of the circuit board 2 at a position inside the cylindrical member 4.

The circuit board 2 has the other surface provided with a metal case 6. The cylindrical member 4, the circuit board 2, and the metal case 6 are covered with an insulating outer case 9.

The monopole antenna 1 has a coil portion 7 wound in a spiral fashion and serving as an inductor because of its shape. The monopole antenna 1 has a predetermined length and serves as a resistor by its length. The monopole antenna 1 also serves as a capacitance under the influence of the helical antenna around the monopole antenna 1. The circuit board 2 has a ground pattern formed on the other surface thereof and serving as a second metallic pattern (not shown). A combination of the first metallic pattern 8 on the one surface of the circuit board 2 and the second metallic pattern on the other surface of the circuit board 2 makes the circuit board 2 itself have a function of a capacitor. Even if the first metallic pattern 8 is not formed, a combination of the circuit pattern 10 and the second metallic pattern can make the circuit board 2 itself have a function of a capacitor.

Thus, a combination of the monopole antenna 1 and the circuit board 2 inside the antenna apparatus forms and RLC circuit. By appropriately changing the length of the monopole antenna 1, the number of turns of the coil portion 7 wound around the monopole antenna 1 in a spiral fashion, and the size of the first metallic pattern 8 formed on the circuit board 2, the structure of the antenna apparatus itself forms the RLC circuit which serves as a matching circuit. Therefore, an additional matching circuit need not be provided in the antenna apparatus.

As described above, according to this invention, the structure of the antenna apparatus itself is modified to have an RLC circuit function without using additional electronic components such as a capacitor, a resistor, and an inductor. Thus, a matching circuit is realized.

What is claimed is:

1. A composite antenna apparatus comprising:

a cylindrical member formed by a flexible insulating member rolled into a cylindrical shape, a circuit board fixed to one axial end of the cylindrical member and provided with a first metallic pattern, and a monopole antenna disposed inside the cylindrical member and standing up on one surface of the circuit board, the circuit board having a second metallic pattern on another surface thereof, the monopole antenna having a spiral wound coil portion, the coil portion serving as an inductor, the monopole antenna serving as a resistor by its length, the first and the second metallic patterns serving as a capacitor, and wherein a combination of the coil portion, the monopole antenna, and the first and the second metallic patterns forming an RLC circuit which serves as a matching circuit.

* * * * *